US005256116A

United States Patent [19]

Robinson

[11] Patent Number: 5,256,116

[45] Date of Patent: Oct. 26, 1993

[54] CLIMBING EQUIPMENT

[76] Inventor: Donald Robinson, 39 Steps, Leeds Road, Old Pool Bank, Otley, West Yorkshire LS21 3BR, United Kingdom

[21] Appl. No.: 878,356

[22] Filed: May 4, 1992

[51] Int. Cl.[5] ..... A63B 69/00

[52] U.S. Cl. ..... 402/37

[58] Field of Search ..... 248/925, 231.9, 200, 248/317; 482/37

[56] References Cited

U.S. PATENT DOCUMENTS

| | | | |
|---|---|---|---|
| 4,575,032 | 3/1986 | Taylor | 248/925 X |
| 4,643,377 | 2/1987 | Christianson | 248/925 X |
| 4,645,149 | 2/1987 | Lowe | 248/925 X |
| 4,832,289 | 5/1989 | Waggoner | 248/925 X |
| 5,092,587 | 3/1992 | Ulner et al. | 248/925 X |

FOREIGN PATENT DOCUMENTS

| | | | |
|---|---|---|---|
| 0329585 | 8/1989 | European Pat. Off. . | |
| 3717027 | 12/1988 | Fed. Rep. of Germany | 248/925 |
| 3739702 | 8/1989 | Fed. Rep. of Germany . | |
| 2602149 | 2/1988 | France . | |
| 2623412 | 5/1989 | France . | |
| 2627988 | 9/1989 | France . | |
| 2628330 | 9/1989 | France . | |
| 2628978 | 9/1989 | France . | |
| 8909635 | 10/1989 | PCT Int'l Appl. . | |

*Primary Examiner*—Ramon O. Ramirez
*Attorney, Agent, or Firm*—Emrich & Dithmar

[57] ABSTRACT

A climbing feature device for installation in or on a climbing surface comprises a plurality of faces having different climbing features thereon, the climbing device being operable, when installed, to present different selectable ones of its faces at a climbing surface. The device may comprise a rotary hexagonal drum having different climbing features on at least some of its six surfaces, which may be presented at the climbing surface as required. On the hexagonal drum, one face could be blank in order to provide no climbing feature at that particular location on the climbing wall if required, with different climbing features on the other surfaces. It is advantageous if the device is designed so that each climbing feature, when presented, is extremely rigidly fixed so that there is no danger to the climber. Further as regards safety, the device is preferably designed to be failsafe, so that it is maintained in a rigidly fixed position should the device fail.

10 Claims, 7 Drawing Sheets

FIG. 8 Section on 'AA'

Section on 'BB'

CLIMBING EQUIPMENT

FIELD OF THE INVENTION

This invention relates to climbing equipment, and more particularly to feature devices for installation into climbing surfaces, and to the climbing surfaces themselves.

DESCRIPTION OF THE PRIOR ART

Rock climbing has for many years been an extremely popular sport, and for several years there has been a demand for rock climbing facilities in geographical regions not benefitting from the presence of natural rock formations. In order to meet this demand, there have been constructed or erected in schools, public sports centres, universities and many other institutions where the demand has arisen, specially designed climbing surfaces upon which the rock climber can practice his skills and more recently to participate in climbing competitions.

These surfaces often take the form of climbing walls and even ceilings, for example the wall being built as normal by bricks, or from concrete, or from a variety of panels usually fastened to a framework. Disclosures of such framework and panel-form of construction can be found in FR-A-2592588, FR-A-2570951 and EP-A-0384439. Set into or bolted onto the wall at seemingly random intervals are features providing protrusions and cracks into which the climber can place fingers and toes for the purpose of ascending the wall.

In the past, brick-built walls have been provided wherein the climbing features are provided in or on hard moulded blocks actually built into the wall to replace groups of adjacent bricks. In such a wall the protrusions and cracks provided by the moulded blocks can provide a plurality of different routes up and down the wall, which the climber can use to practise his skills up and down the wall along the different routes.

One problem with the wall which has just been described is that the climbing features are built into the wall and cannot be changed. Accordingly, the various routes up and down the wall provided by the climbing features are fixed and unchangeable, and a particular climber will in time become accustomed to the configuration of the climbing features in a particular climbing wall and will require further challenges as his skill increases.

A prior proposal for overcoming this problem has been not to build the climbing features immovably into climbing wall, but to build the wall either with a plurality of recesses in the climbing surface thereof or with a facility for bolting on a variety of protruberances (bolt-on holds). The recesses are all identical and are typically circular or hexagonal recesses into which can be fitted replaceable and interchangeable panel discs each of which has on it a particular climbing feature. For example, each disc may have a piece of natural rock fixedly adhered to it, or may have a recess cast into it.

After the wall is built, the panel discs are fitted into their recesses, or the bolt-on holds bolted onto the wall, as required in order to provide the various routes up or down the wall. The advantage over the previously-described fixed wall system is that when required, the panel discs or bolt-on holds can be interchanged in order to provide different routes having differently-arranged climbing features up and down the climbing wall. In order to change the routes in this manner however, it is necessary for a person to climb the wall and physically remove and interchange the panel discs or bolt-on holds, which can take a considerable amount of time.

Examples of such features can be found in FR-A-2602149, FR-A-2628330, and FR-A-2628978.

The problem faced by the present invention is to provide a climbing feature which can be installed in or on a climbing surface and which can provide a more rapid alteration of the nature of the feature should it be required to alter the route along the climbing surface.

SUMMARY OF THE INVENTION

According to one aspect of the present invention there is provided a climbing feature device for installation in or on a climbing surface, comprising a plurality of faces having different climbing features thereon, the climbing feature device being operable, when installed, to present different selectable ones of its faces at a climbing surface.

According to a further aspect of the invention there is provided a climbing surface in or on which is installed a plurality of such devices.

Preferably, a climbing surface, for example a wall, fitted with a plurality of devices according to the invention may be changed simply by operating some or all of the climbing feature devices installed thereon, without it being necessary manually to remove and interchange items such as the aforementioned panel discs or bolt-on holds.

A climbing feature device according to the present invention may comprise a rotary body having different climbing features provided thereon, the body being rotatable in order to present a different climbing feature at the climbing surface as required.

For example, the rotary body may be a drum or wheel rotatable about its axis to present different climbing features as aforesaid.

One example of such a drum could be a hexagonal drum having different climbing features on at least some of its six surfaces, which may be presented at the climbing surface as required.

On the rotary body, one face could be blank in order to provide no climbing feature at that particular location on the climbing wall if required, with different climbing features on the other surfaces.

A climbing feature device according to the present invention could be rendered even more versatile by being provided with a plurality of interchangeable rotary bodies, in order to provide even more different climbing features. For example, a plurality of interchangeable hexagons could be provided.

It is advantageous if the device is designed so that each climbing feature, when presented, is extremely rigidly fixed so that there is no danger to the climber. Further as regards safety, the device is preferably designed to be fail safe, so that it is maintained in a rigidly fixed position should the device fail.

Preferably, the climbing feature device is mechanically operated and can be controlled at a distance so that the presented climbing feature can be altered from for example the foot of the climbing wall or in a control room. In this way, if the majority or all of the climbing features on a climbing surface are provided by devices according to the present invention, the whole nature of a climbing surface could be altered in a very short time, with the climbing routes up and down the surface provided by the climbing features being almost infinitely variable as the different climbing features are altered.

An even more sophisticated control arrangement is envisaged, employing computer control. Thus, if all the climbing features of a climbing wall are provided according to the present invention, each could have its own sensor to detect which climbing feature is presented at any particular time, and all the climbing feature devices could be linked to a central computer which could control the different climbing features almost instantaneously and as required by the operator. The computer could even be preprogrammed to provide particular desired climbing routes, and could perhaps even be programmed to revise climbing routes automatically while the climbing wall is closed to its users, thereby to provide almost daily a different climbing wall for the people who use it.

It is easy to see that the present invention provides a significant step forward as compared with the previous fixed climbing walls, and even the walls having manually interchangeable panel discs or bolt-on holds bearing different climbing features. It is envisaged that climbing surfaces utilising the present invention will be extremely popular because of their versatile nature, the climbing routes along the surface being alterable as required almost at the press of a button or as the result of an order to a computer.

BRIEF DESCRIPTION OF THE DRAWINGS

For a better understanding of the present invention and to show how it may be put into effect, reference will now be made by way of example to the accompanying drawings which show a particular but nonlimiting example of the present invention.

In the figures.

DETAILED DESCRIPTION OF THE DRAWINGS

Figure 1:
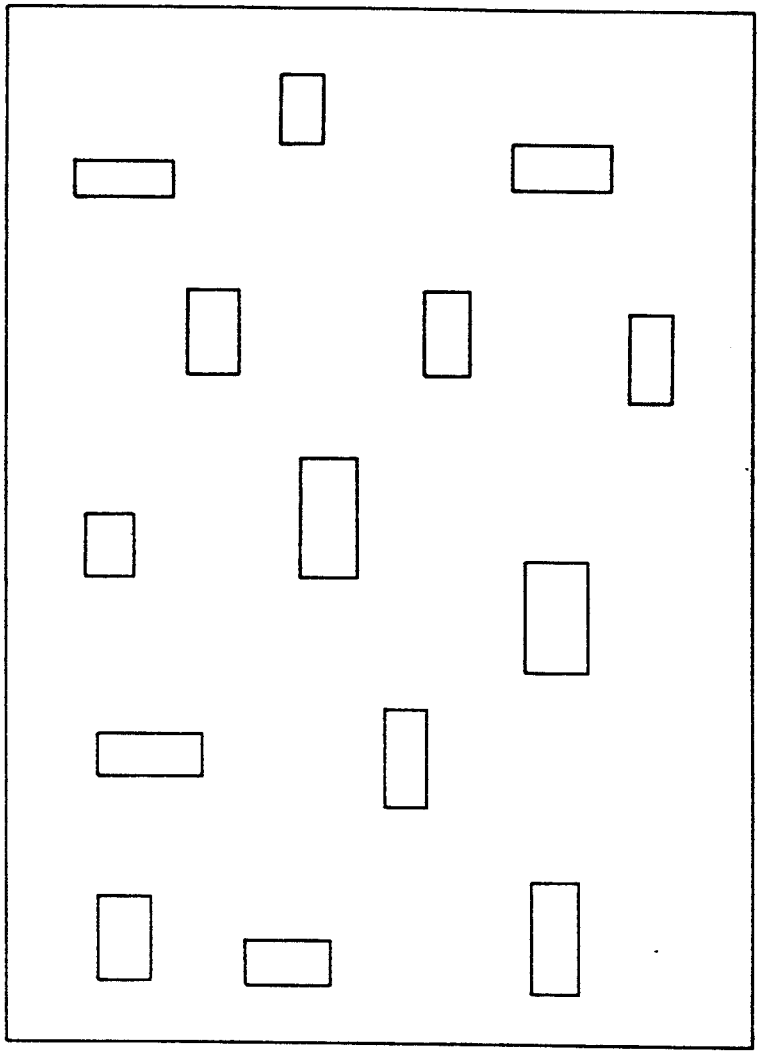
FIG. 1 is a schematic diagram of a small section of climbing wall.

FIG. 1 shows an example of a small section of climbing wall, which is typically 3 meters high by 2 meters across. Set into the wall are the shown rectangular blocks each of which provides a specific climbing feature.

Figure 2:
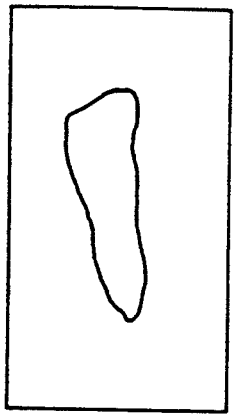
FIGS. 2 and 3 are plan and side views respectively of a climbing feature element in the wall of FIG. 1.
Figure 3:
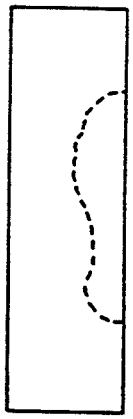

FIGS. 2 and 3 are larger plan and side views of one of the blocks, which provides a finger crack recessed into the depth of the block. Other blocks will have protuberances to be gripped by fingers and toes, and there can be as many different designs of climbing feature as there are different blocks.

In addition to being a wall, the climbing surface can provide a ceiling, and the present invention is not to be limited to either wall or ceiling, but simply to climbing surfaces in general.

Climbing walls and climbing feature blocks as shown in FIGS. 1, 2 and 3 will be familiar to the skilled climber and those engaged in the construction of artificial climbing surfaces.

Figure 4:
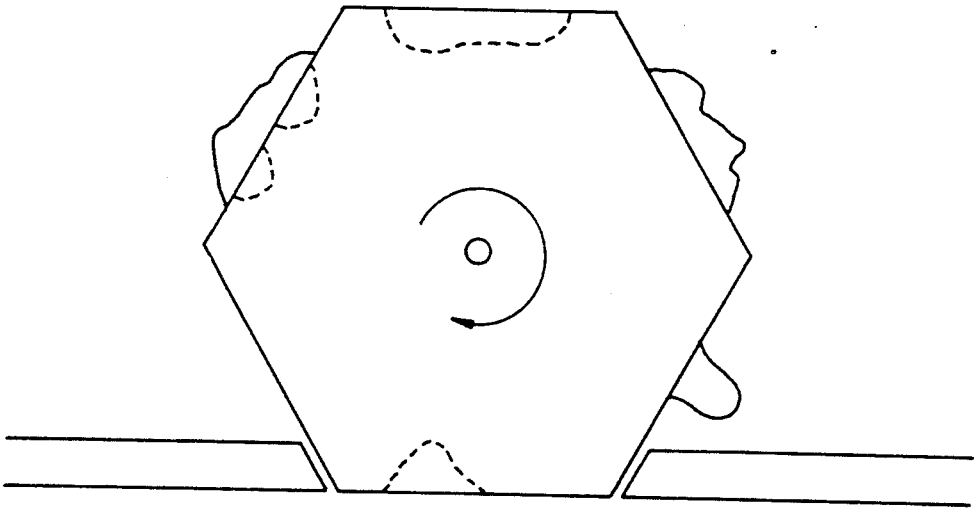
FIG. 4 is a schematic diagram of part of a climbing feature device according to the present invention.

FIG. 4 shows a schematic diagram of a climbing feature device according to the present invention, wherein a regularly hexagonal drum is rotatable about its central axis to provide any one of its six surfaces selectively to provide part of a fixed climbing surface as indicated at the bottom of the figure.

The top and bottom surfaces of the hexagonal drum are provided with finger cracks, the two right-hand surfaces are provided with protrusions to be held by the toes and the fingers, the top left-hand surface comprises both finger cracks and a protrusion in combination, and the bottom left-hand surface is left blank to provide a smooth climbing surface at the point of the device if required.

The hexagonal drum is rotated as required in order to present whatever climbing feature is required at the climbing wall. In order to prevent the corners of the hexagon and the protrusions striking the edges of the aperture in the climbing wall, the aperture being provided to allow the selected climbing feature to be presented, the hexagonal drum is withdrawn perpendicularly from the wall before it is rotated each time.

Figure 5:
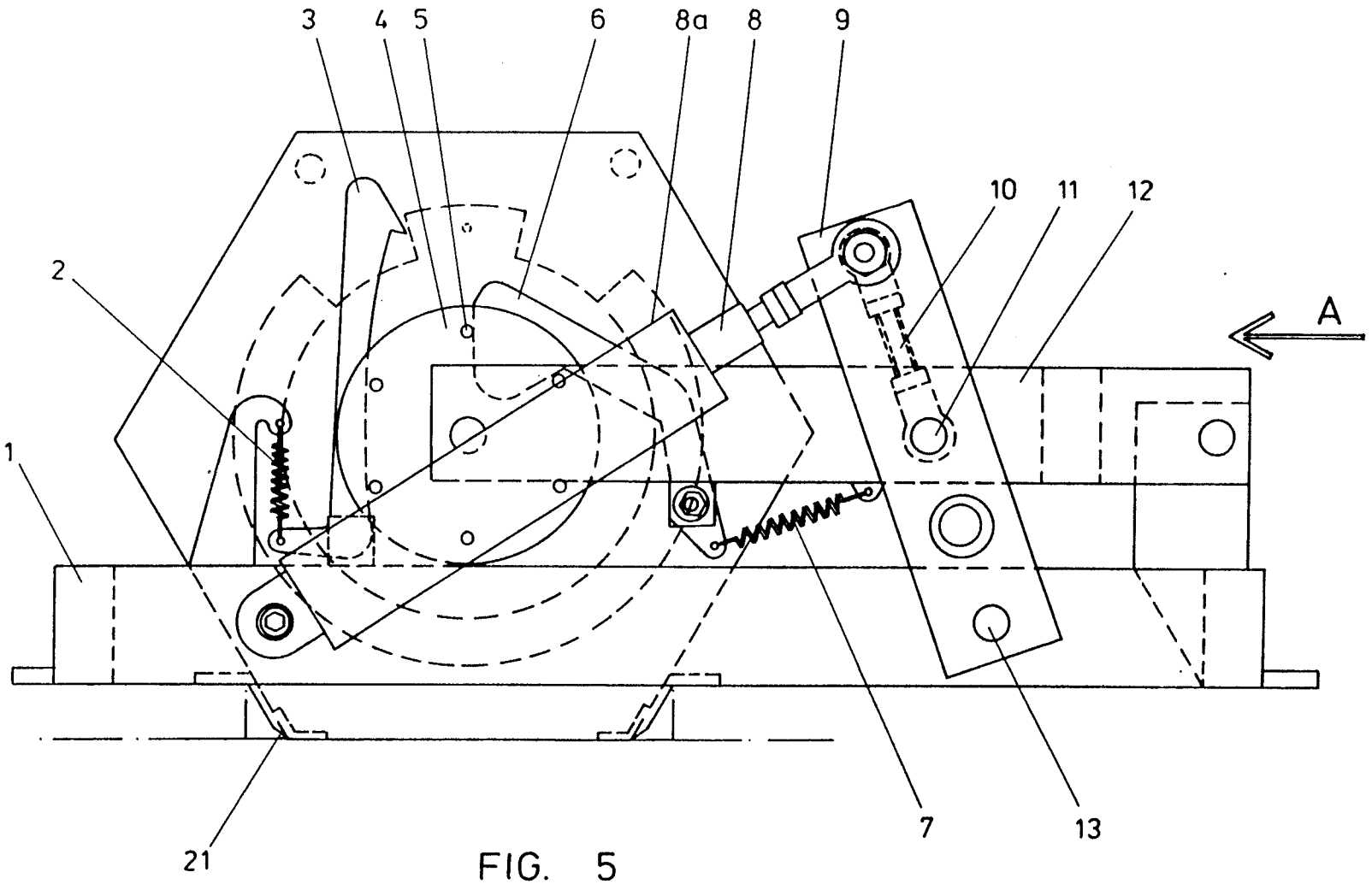
FIG. 5 is the side view of a mechanism of a climbing feature device.
Figure 6:
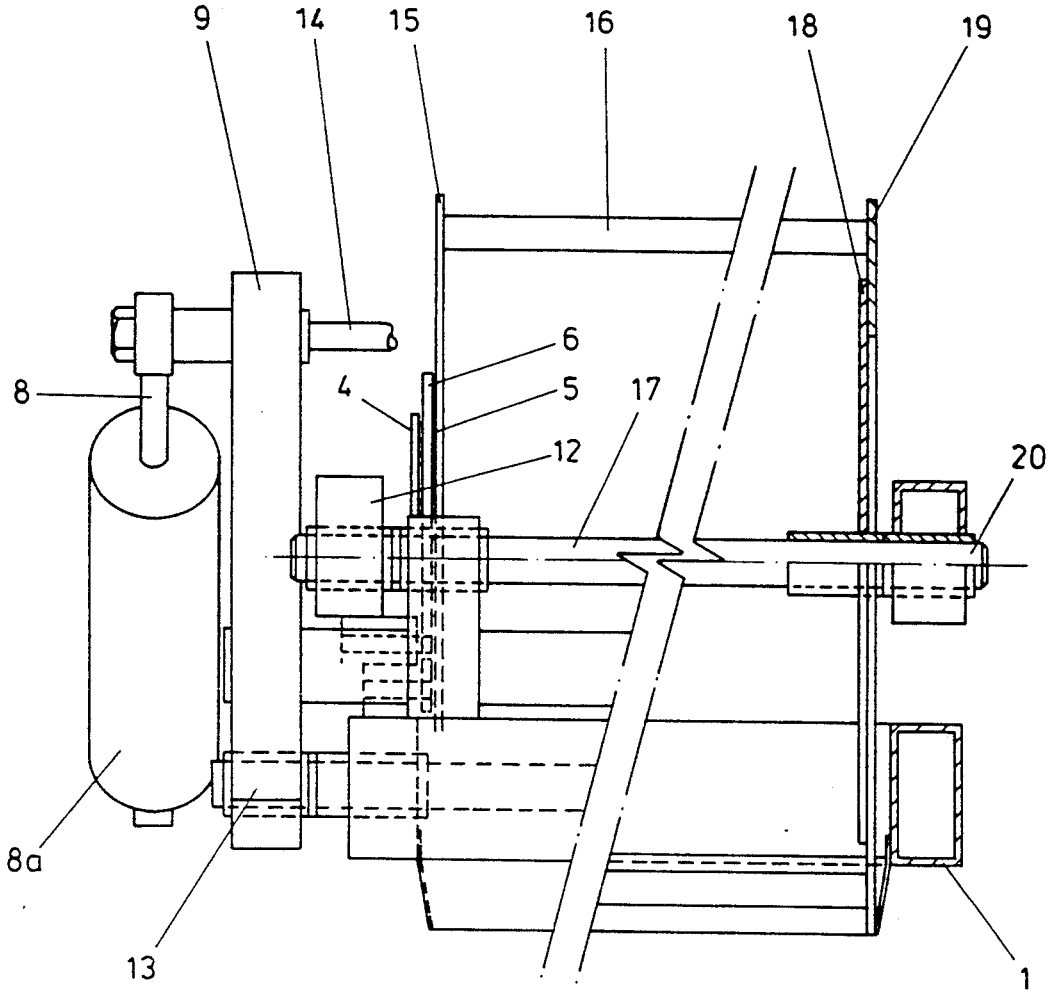
FIG. 6 is an end view of the device of FIG. 5, seen in the direction of arrow A in FIG. 5.

FIGS. 5 and 6 are a side view and an end view respectively of one example of climbing feature mechanism according to the present invention. In use, the mechanism is bolted at the rear of a climbing frame wall so that the hexagonal drum is presented at the front of the wall as shown in FIG. 4.

The device comprises a frame 1 which is employed to bolt the device by end lugs to the rear of a climbing wall, and which supports the remainder of the mechanism.

A tension spring 2 urges a ratchet arm 3 to pivot clockwise, to cooperate with six dowels 5 arranged at equal angles around a support plate 4 which is rigidly fixed to the regularly hexagonal drum shown clearly in outline.

A detent arm 6 is urged to pivot anti-clockwise by a further tension spring 7, to engage between adjacent ones of the dowels 5 as shown.

The driving power for the device is provided by a pneumatic piston and cylinder arrangement which is pivotable about its bottom end and which comprises a piston 8 and a cylinder 8*a* as shown. The top end of the piston 8 is pivoted to a toggle arm 9 which itself is pivoted about its bottom spindle 13.

A swinging arm 12 is pivotally supported at its right-hand end, and carries the hexagonal drum rotatably at its left-hand end. A toggle link 10 connects the upper end of the piston 8 to a toggle spindle 11 supported on the swinging arm 12.

As can be seen more particularly from FIG. 6, a cross shaft 14 is provided at the top end of the toggle arm 9, and the hexagonal drum is providedwith end plates 15 and 19. Spacers 16 separate the end plates 15 and 19 to provide the depth of the hexagonal drum, which rotates on a swinging arm spindle 17. 20 denotes one end of the hexagonal spindle 17.

The hexagonal drum is shown in FIG. 6 to have any required depth depending upon the size of the climbing features. Typically, a climbing feature such as shown in FIGS. 2 and 3 will have a length dimension of 300 mm and a width dimension of 150 mm. Accordingly, the hexagonal drum of FIGS. 5 and 6 will have the sides of its hexagon each equal approximately to 150 mm, with it axial length being 300 mm.

Although not shown in FIGS. 5 and 6 for the sake of clarity, the hexagonal drum will carry on its six sides, six rigid panels adapted to receive six different climbing feature elements such as are shown for example in FIGS. 2 and 3. The climbing feature elements can be bolted onto these panels and replaced as required. For the sake of clarity in FIGS. 5 and 6, neither these panels nor the attached climbing feature elements are shown.

The operation of the climbing feature device is as follows.

In its rest position with a climbing feature presented at the climbing wall surface, the mechanism is in the position shown in FIGS. 5 and 6. In FIG. 5 it can be seen that the frame 1 has at its bottom surface a rectangular protruding lip 21 into which extends the bottom edge of the hexagonal drum. This bottom lip 21 will extend at least partially through the thickness of the climbing wall.

When the presented climbing feature is to be changed, the pneumatic piston and cylinder 8,8*a* is actuated to extend the piston 8 out of the cylinder 8*a*. The toggle arm 9 accordingly pivots in the clockwise direction about its toggle arm spindle 13, and this motion is facilitated by the piston and cylinder 8,8*a* being pivotable about its bottom end.

As the toggle arm 9 pivots, the toggle link 10 pulls upwardly on the toggle spindle 11 and pivots upwardly the swinging arm 12. This lifts the hexagonal drum substantially vertically away from the frame 1, along the circumference of a large circle centred at the right-hand end of the swinging arm 12.

As the drum moves upwards in this manner, the upper tooth of the ratchet arm 3 comes into contact with the upper left-hand dowel 5 and therefore causes the hexagonal drum to rotate anti-clockwise as the drum moves upwards. In this position, the drum is free of the lip 21 and can rotate freely. The detent arm 6 is pushed in a clockwise direction by the upper right-hand dowel 5 so that it does not prevent the hexagonal drum turning.

When the hexagonal drum reaches its furthest distance away from the frame 1, it has been rotated through 60° so that the next climbing feature faces downwards.

At this point the piston and cylinder 8,8*a* is reversed in operation. Without an further rotation of the hexagonal drum, the piston 8 withdraws into the cylinder 8,8*a*, the toggle arm 9 rotates anti-clockwise and takes with it the swinging arm 12 with the aid of the toggle link 10. At the end of the travel of the mechanism, it is returned to the position shown in FIGS. 5 and 6, but with the next adjacent climbing feature being presented at the climbing wall. The detent arm 6 prevents clockwise rotation of the drum.

Because a toggle mechanism is provided, it is only possible to move the hexagonal drum using the piston and cylinder 8,8*a*. It is impossible to push the hexagonal drum inwards by pushing on a climbing feature fixed to the presented face thereof, and moreover if the mechanism fails (e.g. by evacuation of the cylinder 8*a*) it fails safe in the position shown so that there is no danger at all to the climber.

FIGS. 4, 5 and 6 show a horizontal climbing surface and indeed a climbing ceiling or roof would be provided in this manner. Nevertheless, this is a non-limiting example and it is clear that the described and illustrated climbing feature device could work equally well on a vertical or slanting climbing wall.

Several alternatives to the particularly described and illustrated mechanism are envisaged, and for example instead of a hexagonal drum a spoked wheel having climbing features located at the end of the spokes could provide the basis for an alternative form of mechanism according to the present invention.

Figure 7:
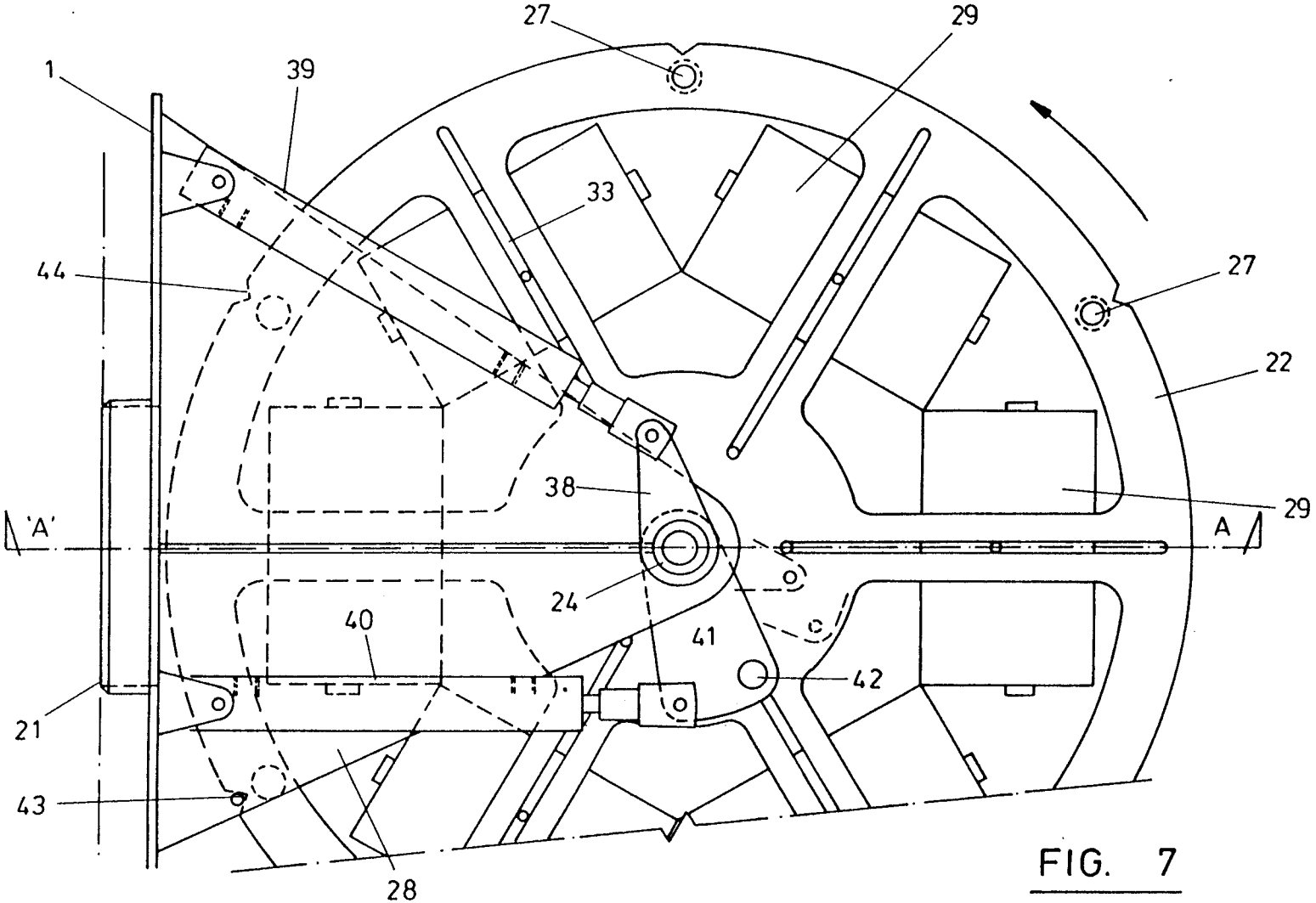
FIG. 7 is the side view of a further mechanism of a climbing feature device.
Figure 8:
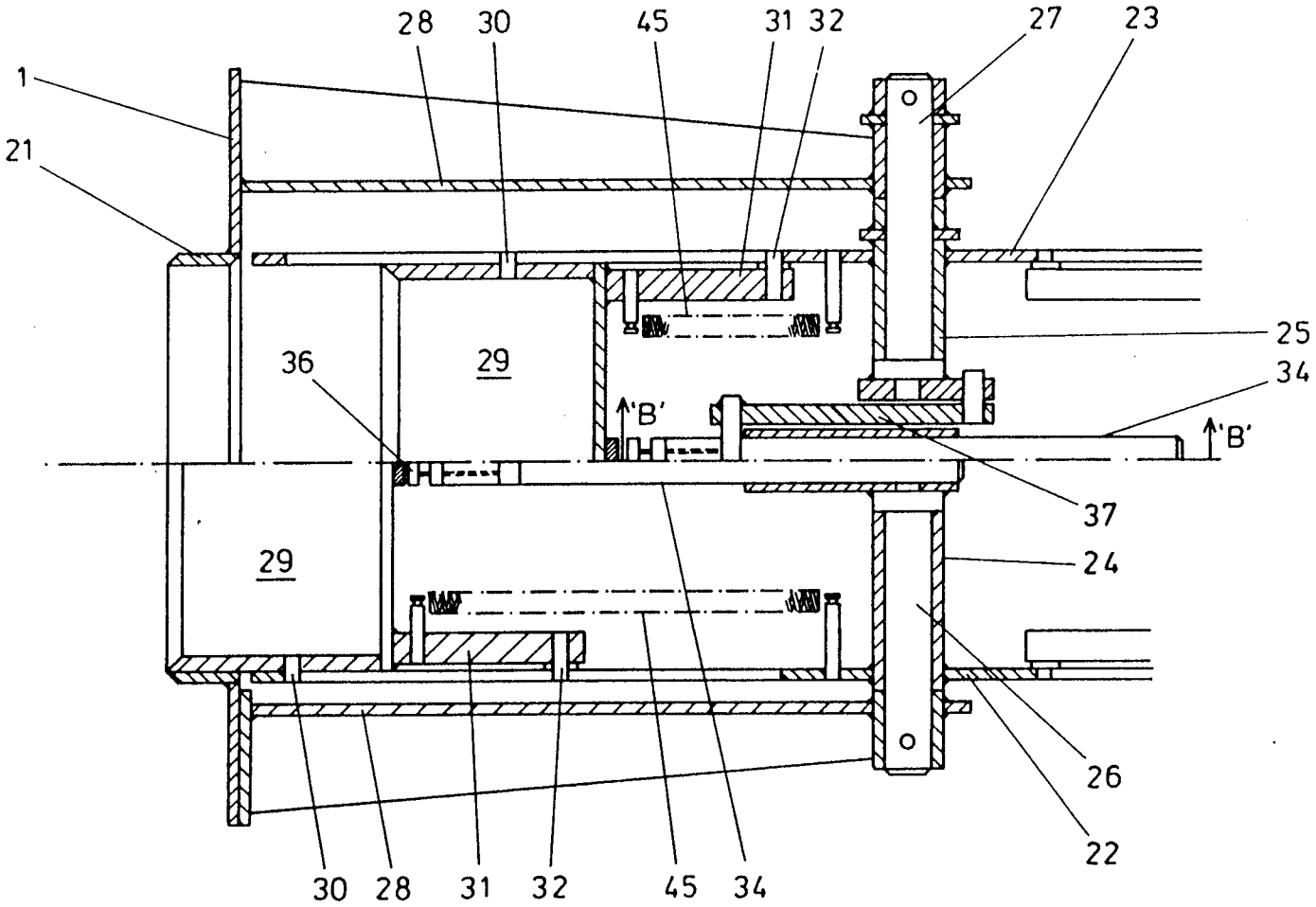
FIG. 8 is a section of FIG. 7.

Such an alternative form of mechanism is shown in FIGS. 7 and 8, which are a side view and a section AA respectively of the mechanism, similarly to the views of FIGS. 5 and 6. In this case however, it can be seen that the mechanism is shown in a different orientation. Thus, in FIG. 7 the frame 1 which is employed to bolt the mechanism to the rear of a climbing wall, and which supports the remainder of the mechanism, is shown in FIG. 7 at the left hand side of the Figure. This is simply for convenience so that the mechanism, which is rather larger than that of FIGS. 5 and 6, can be shown conveniently although this has necessitated the bottom part of the mechanism being cut-off as shown. That part of the mechanism which is missing because of this, is symmetrical with the corresponding upper part and can therefore easily be imagined.

In this embodiment, instead of a stepping hexagonal drum being used as in the previous embodiment, a spoked wheel is provided. The construction of the wheel can best be imagined as being similar to that of a fairground or Ferris wheel, with two similar spoked circular sides 22 and 23. These are mounted at the centre on sleeves 24 and 25 respectively, which are rotatable freely on half-shafts 26 and 27. The wheel sides 22 and 23 are fixedly joined together and spaced apart at their peripheries by six equally spaced spacer bars 27.

The half-shafts 26 and 27 of the wheel are supported on the frame 1 via two support brackets 28 welded to the frame 1. Each support bracket 28 is substantially triangular in shape when viewed from the side, as can be seen from FIG. 7, and has a central reinforcing flange extending outwardly, as can be seen from FIG. 8.

The two spaced-apart wheel sides 22 and 23 hold between them six rectangular buckets 29 arranged symmetrically at 60° apart around the wheel, and supported between the respective spokes of one wheel side 22 and the corresponding spokes of the other wheel side 23.

Each bucket 29 contains a different climbing feature member (not shown for the sake of clarity) which faces radially outwards and, when a desired bucket 29 is aligned with the rectangular protruding lip 21 shown in FIG. 7, that bucket is projected forwardly to the end of the spoke which is directed radially towards the centre of the rectangular protruding lip 21. The radially outer edge of the bucket 29 fits into the lip 21 and the contained climbing feature member is thus presented at the surface of the climbing wall, which extends around the outer circumference of the protruding lip 21. Examples of climbing features which could be used are shown in FIGS. 2 to 4 for example.

In FIG. 7, all the buckets 29 are shown at their radially innermost positions, in which they all abut one against the next at their inner corners.

FIG. 8 shows this radially innermost position of the left-hand bucket 29 above the horizontal centre line of the Figure, with the outermost radial position of this same bucket 29 being shown below the horizontal centre line.

Each bucket has two limbs 31 extending radially behind the bucket 29, and pins 30 in the side walls of the bucket 29, and pins 32 at the end of the limbs 31 fit into slots 33 in the radial spokes of the wheel sides 22 and 23. In this way the buckets 29 are guided along the slots 33 in their radial travel, and do not tilt in this travel.

Figure 9:
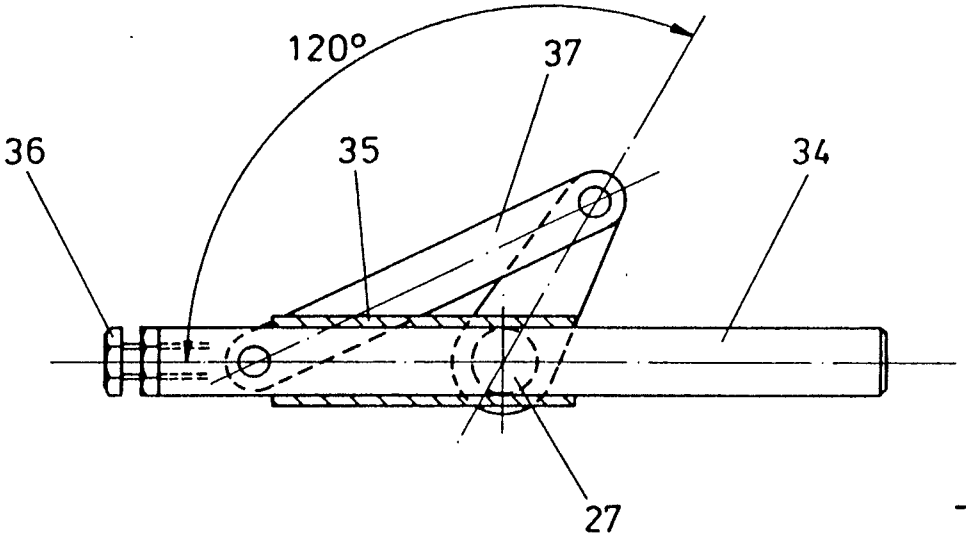
FIGS. 9 and 10 are details of the mechanism of FIG. 8.
Figure 10:
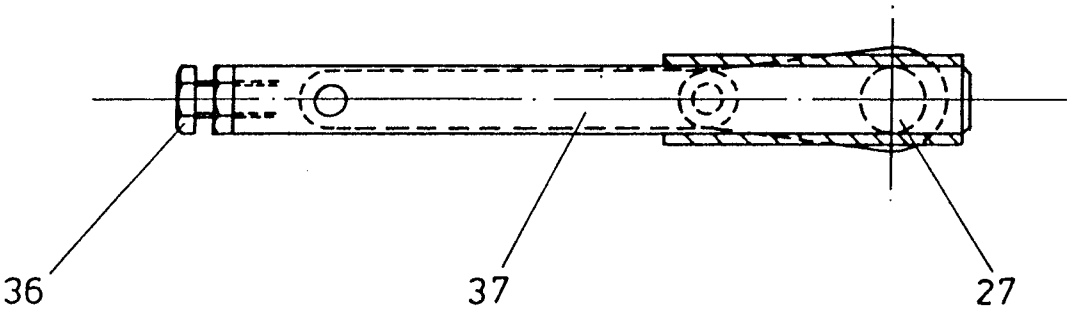

In order to move a bucket 29 from its innermost to its outermost radial position to fit into the lip 21, a toggle mechanism 37 is provided as shown in FIG. 9 and in the upper half of FIG. 8 in the closed position with the bucket at its innermost position, and in FIG. 10 and in the lower half of FIG. 8 in its forward position with the bucket in its outermost position. A bucket push rod 34 is axially slidably mounted in a sleeve 35, and is actuated by the toggle mechanism 37 to push the aligned bucket outwards by a stud 36 at the forward end of the rod 34.

The toggle mechanism 37 and the push rod 34 are housed between the two wheel sides 22 and 23 so that the rod 34 is always aligned in the same direction irrespective of the rotational angle of the wheel. Thus, any selected bucket can be actuated by the rod 34 in dependence upon the angle of the wheel.

The toggle mechanism 37 is actuated by a rotation of the half-shaft 27, which is rotated by a lever 38 fixed to it and driven by a piston and cylinder arrangement 39 pivotally coupled to the frame 1. The centre line of the cylinder of this arrangement is shown in FIG. 8, although the cylinder and the coupling itself are not shown in detail therein for the sake of clarity.

The wheel is rotatable by means of a second piston and cylinder arrangement 40 which is also pivotally secured to the frame 1 at one end and, at its other end, is pivotally coupled to a centrally mounted bracket 41 secured to the wheel side 22 via a strong coupling pin 42.

A spring biased detent pin 43 can co-operate with notches 44 in the outer edge of wheel side 22, in order to locate the wheel as a whole at six positions wherein a bucket 29 can be actuated by the rod 34 to enter the protruding lip 21.

Operation of the mechanism shown in FIGS. 7 to 10 is as follows:

Assume the wheel is in the FIG. 7 position with all buckets 29 withdrawn to their innermost positions as shown, with the piston and cylinder arrangement 39 extended to the dotted position of lever 38. If it is then desired to present at the climbing wall a climbing feature provided at the radially outermost surface of the left-hand bucket in FIG. 7, the piston and cylinder arrangement 39 is actuated to the shown position to rotate the half-shaft 27 via the lever 38 in the anti-clockwise direction. The toggle mechanism 37 is moved from its FIG. 9 position to the FIG. 10 position (corresponding to the position of the bracket 38 in FIG. 7) and the left-hand bucket 29 will be pushed radially outwardly by the stud 36. The toggle mechanism 37 will be locked in the FIG. 10 position, which is its fail-safe position. No amount of human pressure applied to the climbing feature would break the toggle link and thus cause the feature to be withdrawn inwardly, and this is a safety feature of the mechanism. The toggle mechanism can only be broken by actuation of the piston and cylinder arrangement 39 to rotate the half-shaft 27.

When it is desired to alter the climbing feature displayed at the climbing wall, the toggle mechanism is broken from the FIG. 10 to the FIG. 9 position by operation of the piston and cylinder arrangement 39, and this allows two stretched springs 45, extending between the hubs of the wheel sides 22 and 23 and points on the bucket limbs 31, to return the left-hand bucket 29 to its innermost position.

All the buckets 29 are now in the positions as shown in FIG. 7, and the piston and cylinder arrangement 40 can be actuated in order to place the wheel in any desired one of its five further rotational positions in order to choose any of the five other climbing features to be displayed at the climbing wall surface in the manner described hereinbefore.

The mechanisms shown in FIGS. 5 and 6 on the one hand, and in FIGS. 7 to 10 on the other hand, are shown roughly to scale. Although the second mechanism is rather larger than the first, it is possible to select any one of the six climbing features simply by rotating the wheel to the particular position required, and then driving the bucket chosen radially outward. It is not necessary to step the mechanism through each climbing feature until a selected one is present at the climbing wall, as is the case with the embodiment of FIGS. 5 and 6.

Further refinements could be employed also. For example when the hexagonal drum or the bucket is withdrawn from the climbing wall, compressed air could automatically be directed at the just-withdrawn climbing feature in order to clean it, for example particularly from chalk powder which climbers sometimes apply to their hands.

A climbing surface could incorporate devices such as shown in FIGS. 4, 5 and 6, or FIGS. 7 to 10, in order to provide many variable climbing features. All these devices could be separately remotely controlled from the bottom of a climbing wall, or even from a separate control room. In more sophisticated applications, a computer could be programmed to control all the variable features of a climbing surface, so that a particular climbing surface could provide an almost infinitely variable computer-controlled selection of routes upon it.

It is possible with the mechanisms illustrated in FIGS. 5 and 6, and 7 to 10, to provide a very close fit between the inner surface of the lip 21, and that part of the hexagon or bucket which enters into it. In this way the climber will be forced to employ the climbing feature provided, and will not be tempted to employ any cracks between the lip 21 and the hexagon or bucket part which fits into it.

I claim:

1. An artificial climbing hand and foot hold device for use with a climbing surface to simulate hand and foot holds in natural climbing conditions, said device comprising: a body having plurality of faces, a plurality of different artificial climbing hand and foot holds carried by at least predetermined ones of said faces, support means for supporting said body in a supported condition adjacent to the climbing surface, and drive means for moving said body relative to the climbing surface while said body is in its supported condition to selectively present one of said faces and any climbing hand and foot hold thereon at the climbing surface for engagement by a climber's hand or foot.

2. The device of claim 1, wherein said drive means includes means for rotating said body about an axis for selectively presenting said faces at the climbing surface.

3. The device of claim 2, wherein said body comprises a hexagonal drum having six of said faces.

4. The device of claim 2, wherein said drive means includes means for moving said body toward and away from the climbing surface.

5. The device of claim 2, wherein said body comprises a wheel, and further comprising a plurality of carrier members respectively having said faces thereon, said drive means including means for moving said carrier members relative to said wheel between extended positions for presenting said climbing hand and foot holds at the climbing surface and retracted positions.

6. The device of claim 1, wherein the climbing surface has an opening therein, said support means including means positioning said body so that the selected one of said faces is disposed in said opening.

7. The device of claim 6, wherein the climbing surface has a reverse side, said support means including a frame for supporting said body on the reverse side of the climbing surface, said frame including a lip which protrudes into the climbing surface from the reverse side thereof for surrounding a presented one of said faces with a very close fit.

8. The device of claim 1, wherein said drive mechanism includes means for effectively latching said body in each of a plurality of different positions respectively presenting said faces at the climbing surface for effectively locking the presented faces and any climbing hand and foot hold thereon against movement relative to the climbing surface except by operation of said drive means.

9. In combination: an artificial climbing surface; and a plurality of artificial climbing hand and foot hold devices disposed adjacent to said climbing surface; each of said devices including a body having a plurality of faces, a plurality of different artificial climbing hand and foot holds carried by at least predetermined ones of said faces, and drive means for moving said body relative to said climbing surface to selectively present one of said faces and any climbing hand and foot hold thereon at said climbing surface for engagement by a climber's hand or foot.

10. The combination of claim 9, wherein said climbing surface has an obverse side and a reverse side and a plurality of openings therein, and further comprising support means supporting said devices on said reverse side of said climbing surface respectively adjacent to said openings, said drive means including means for moving the selected ones of said faces respectively into the adjacent ones of said openings.

* * * * *